US006378216B1

(12) United States Patent
Meyer

(10) Patent No.: US 6,378,216 B1
(45) Date of Patent: Apr. 30, 2002

(54) WALLPAPER CUTTER

(75) Inventor: Barbara Meyer, Otterville (CA)

(73) Assignee: Frank Meyer, Milford, MI (US)

( * ) Notice: Subject to any disclaimer, the term of this patent is extended or adjusted under 35 U.S.C. 154(b) by 0 days.

(21) Appl. No.: 09/371,548

(22) Filed: Aug. 10, 1999

Related U.S. Application Data

(60) Provisional application No. 60/096,255, filed on Aug. 12, 1998.

(51) Int. Cl.[7] ..... B26B 5/00

(52) U.S. Cl. ..... 30/293; 30/294

(58) Field of Search ..... 30/125, 2, 293, 30/294, 306, 319, 164.95, 292, 307, 41

(56) References Cited

U.S. PATENT DOCUMENTS

| | | | | | |
|---|---|---|---|---|---|
| 920,482 | A | * | 5/1909 | Koscherak | 30/41 X |
| 1,255,860 | A | * | 2/1918 | Courter | 30/2 |
| 3,525,152 | A | * | 8/1970 | Fattori et al. | 30/2 |
| 4,432,137 | A | * | 2/1984 | Okada | 30/319 X |
| 4,669,186 | A | * | 6/1987 | Liu | 30/125 |
| 5,584,123 | A | * | 12/1996 | Chi | 30/125 |

* cited by examiner

*Primary Examiner*—Douglas D. Watts
(74) *Attorney, Agent, or Firm*—Young & Basile, PC

(57) ABSTRACT

A wallpaper cutter for cutting hung wallpaper at ceiling-to-wall and wall-to-wall joints. The apparatus includes a body having a removable cutter extending beyond the body. The wallpaper cutter body is translated along a wall or ceiling such that the cutter precisely cuts the excess wallpaper at the wall or ceiling joint.

10 Claims, 2 Drawing Sheets

WALLPAPER CUTTER

CROSS REFERENCE TO CO-PENDING APPLICATION

This application claims the benefit of tile priority date of Provisional Application Ser. No. 60/096,255, filed Aug. 12, 1998 in the name of Barbara Meyer, the entire contents of which are incorporated herein by reference.

FIELD OF THE INVENTION

The present invention relates to a cutting apparatus, particularly used for cutting wallpaper and more particularly for cutting hung wallpaper at ceiling-to-wall and wall-to-wall joints.

BACKGROUND OF THE INVENTION

When wallpapering interior walls, one of the hardest tasks is to trim the wallpaper in a straight line at the juncture of two walls or between a wall and the ceiling. This task is further complicated by surface irregularities found at the joints between such walls and ceilings.

Typically, a razor blade or utility knife is used with a straight edge or guide to trim excess wallpaper off of each sheet of hung wallpaper at the wall-to-wall or wall-to-ceiling joint. Due to different paper thicknesses and joint irregularities, it is difficult, even for professionals, to trim the wallpaper precisely along the joint.

Thus, it would be desirable to provide a wallpaper cutter which facilitates the trimming of excess wallpaper from a hung strip of wallpaper. It would also be desirable to provide a wallpaper cutter which easily trims excess wallpaper from a sheet of wallpaper at a wall-to-wall or wall-to-ceiling joint. It would also be desirable to provide a wallpaper cutter which can easily accommodate different thickness of wallpapers.

SUMMARY OF THE INVENTION

The present invention is a unique wallpaper cutter which easily enables excess wallpaper to be trimmed from a hung strip of wallpaper at a wall-to-ceiling or wall-to-wall joint.

The present invention includes an elongate body suitable for ease of gripping and manipulation by hand. The body includes a top end preferably having a sloped top end surface and an adjoining top edge elevated from the top end surface. The present invention provides a cutter which is removably attached to the top end surface such that a portion of the cutter extends beyond the exterior of the body. The present invention further provides a means for adjusting the depth of cut by the cutter to accommodate different thicknesses of wallpaper and a removable, hollow end cap at the bottom end of the body to store replacement or alternate cutters.

The wallpaper cutter of the present invention is of simple construction for a low manufacturing cost and easy long term, reliable use. The wallpaper cutter also is capable of following any non-straight imperfections at a wall-to-ceiling or wall-to-wall joint so as to ensure that the excess wallpaper is precisely trimmed from the hung strip of wallpaper. The wallpaper cutter of the present invention also accommodates different thickness wallpapers without damaging the underlying wall, ceiling surface or tape or plaster joint therebetween.

BRIEF DESCRIPTION OF THE DRAWINGS

The various features, advantages and other uses of the present invention will become more apparent by referring to the following detailed description and drawing.

DETAILED DESCRIPTION OF THE INVENTION

Figure 1:
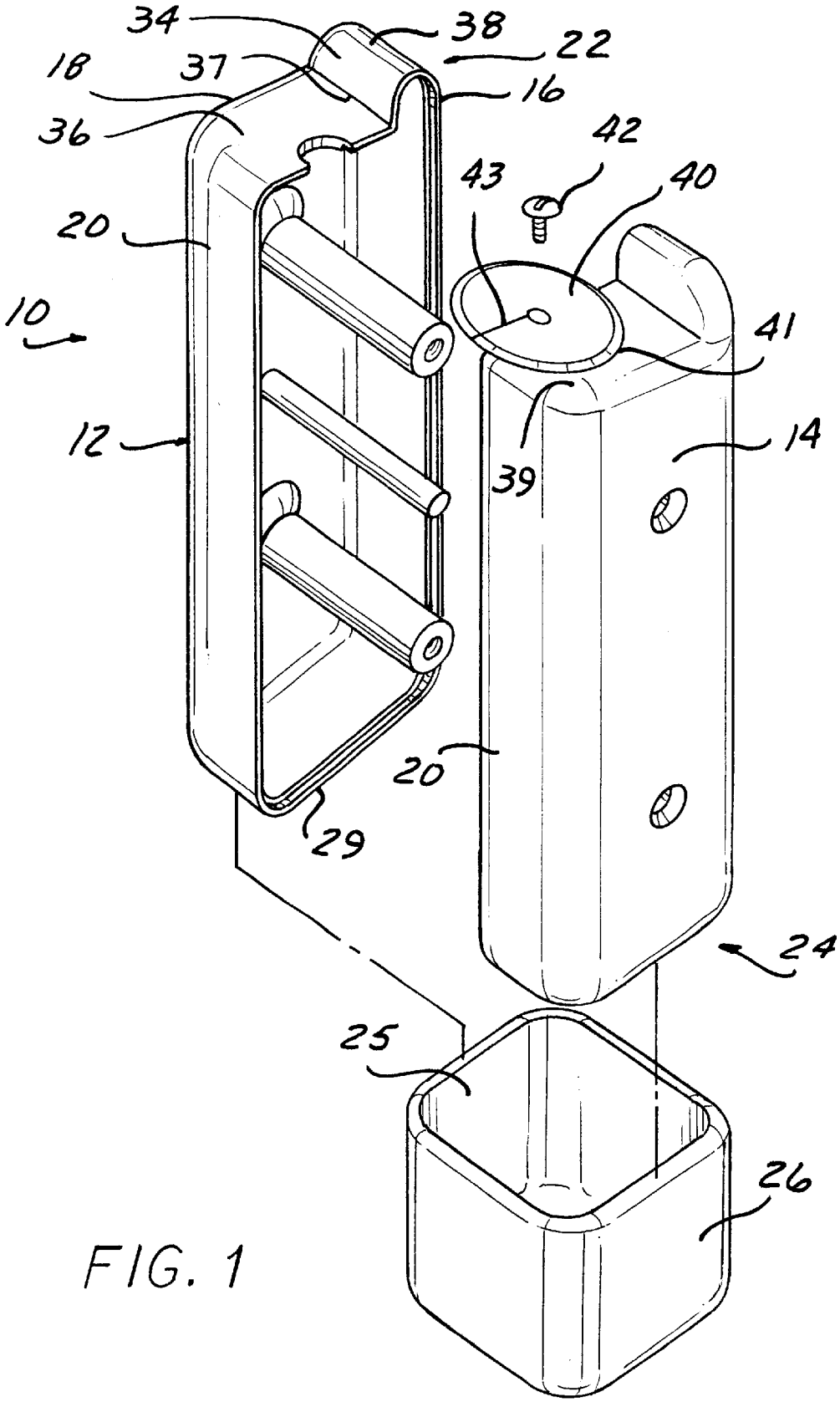
FIG. 1 is an exploded, perspective view of a wallpaper cutter according to the present invention.

Referring now to FIGS. 1–5, there is depicted a wallpaper cutter 10 according to the present invention. As best seen in FIG. 1, the wallpaper cutter 10 includes a body 12 having a hand grippable configuration. The body 12 is preferably of an elongated shape with an exemplary square cross section to enable it to be easily grasped by a hand. Thus, the body 12 is preferably formed with an exterior periphery having four side walls 14, 16, 18 and 20. The body is further defined by a top end 22 and a bottom end 24. In alternate aspects, the body 12 may be cylindrical in shape or may have one or more substantially flat side walls.

The body 12 may be formed of any suitable material with light weight materials, such as substantially rigid plastics, wood, etc., being preferred. A metal body 12 may also be constructed for industrial or professional use.

Figure 5:
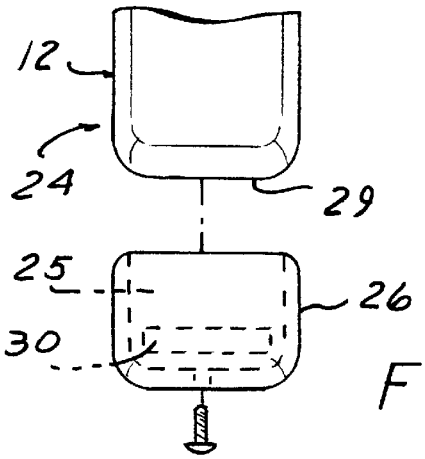
FIG. 5 is a partial, exploded side elevational view of the wallpaper cutter shown in FIG. 1.

The body 12 may be substantially solid or include a hollow interior cavity as shown in FIG. 1. Referring now to FIGS. 1 and 5, in a preferred aspect of the invention, an end cap 26 is releasably secured to the body 12 by means of a fastener or screw 28 which extends through the bottom wall of the end cap 26 and into a solid end portion 29 of the body 12. Preferably, the end cap 26 includes a hollow interior chamber 25 in which additional cutters or cutter wheels 30 may be stored. In an alternate aspect, end cap 26 is removably attached to body 12 through use of other mechanical fastening devices such as spring clips and the like. In an alternate aspect, the body 12 has an interior cavity open to said bottom end 24 which is closed or covered by end cap 26 through threading engagement with said body 12 or through other mechanical fasteners as described.

Figure 2:
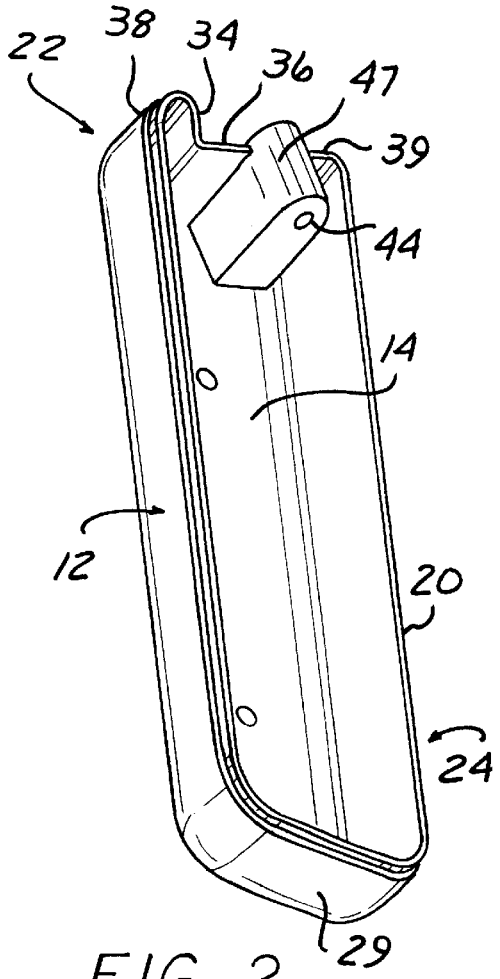
FIG. 2 is a partial perspective view of the wallpaper cutter shown in FIG. 1.
Figure 3:
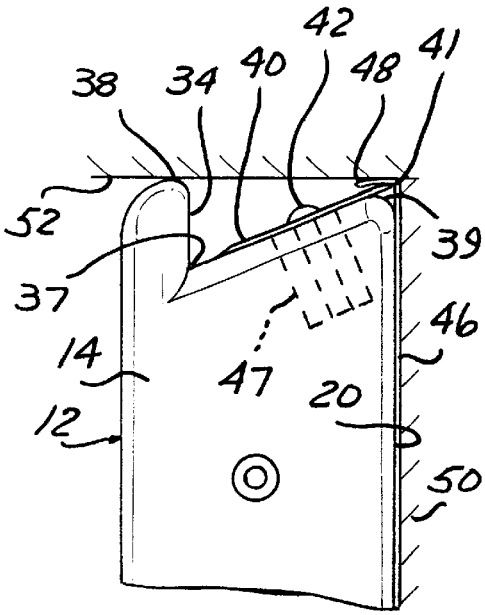
FIG. 3 is a side elevational view showing the use position of the wallpaper cutter of FIGS. 1 and 2 in trimming excess wallpaper from a hung strip of wallpaper at a wall-to-ceiling joint.

As shown in FIGS. 1–3, the top end portion 22 of the body 12 is cut out or notched to form a wall or flange 34. Wall 34 has a base 37 joining top end surface 36 to wall 34. Wall 34 terminates in a top edge 38. The wall 34 is generally adjacent to and a contiguous extension of the side wall 16. The top end surface 36, however, is preferably disposed at a shallow or small angle with respect to wall 34 and the top edge 38. Preferably as shown more clearly in FIG. 3, the top end surface 36 angularly slopes or declines from an outer edge 39 adjacent the side wall 20 to the base 37 of wall 34.

Figure 4:
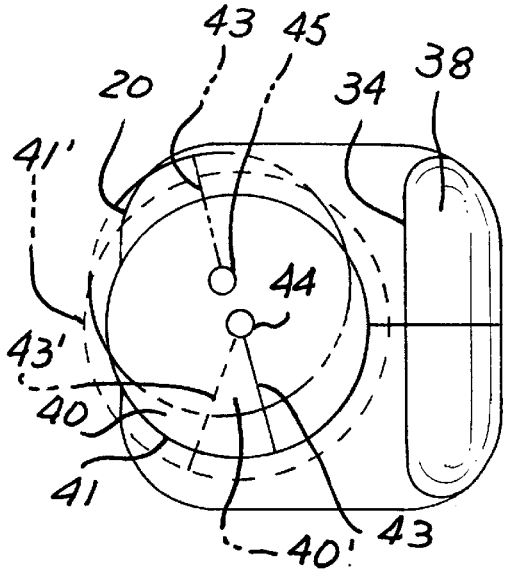
FIG. 4 is a plan view showing the mounting of different cutters on the body of the wallpaper cutter of FIGS. 1–3.

The wallpaper cutter 10 further includes a means for cutting the wallpaper 36. As shown in FIGS. 1–4, a cutter 40 is, preferably, removably and rotatably mounted on the top end surface 36 by means of a fastener 42 through a first mounting bore 44 in the top end surface 36. As seen in FIGS. 2 and 3 top surface 22 preferably includes a mounting boss 47 which receives fastener 42. The cutter 40 is preferably in the form of a rotatable thin metal disk having a beveled edge forming a sharp peripheral cutting edge 41. The peripheral cutting edge 41 is the distance or length 43 from the attachment point of the cutter 40 to the mounting bore 44 in the top end surface 36. In an alternative aspect, a straight cutter, such as a conventional utility razor blade, may be employed. Although preferably described and shown as a single cutter 40, an alternate aspect includes two or more cutters 40 or a single cutter with multiple cutting edges 41 on a single cutter 40. As best seen in FIGS. 3 and 4, when cutter 40 is mounted in first bore 44, a small portion of cutter 40 including the peripheral cutting edge 41 extends beyond outer edge 39 and side 20. In a preferred aspect, cutter 40 is positioned in an angled orientation on sloped top end surface 36 such that cutter 40 angularly projects outwardly and upwardly from outer edge 39 and side 20 as best seen in FIG. 3. In this position, cutting edge 41 is at a height or elevation equal to, or slightly below, top edge 38.

The wallpaper cutter 10 of the present invention is also provided with means for adjusting the depth of cut of the cutter 40 to accommodate different thickness wallpapers, such as wallpaper 46 shown in FIG. 3. The adjusting means is preferably provided in one of two ways:

1. In a first implementation, as shown in FIG. 4, a single diameter cutter 40 is removably and rotatably mounted on the top end surface 36 by fastener 42 through a first mounting bore 44. However, a second mounting bore 45 is formed in the top end surface 36 closer in proximity to the body exterior periphery, shown in FIG. 4 as side wall 20, so as to receive the fastener 42 and to position the cutter 40 so that the peripheral cutting edge 41 of the cutter 40 extends further outward from the side wall 20 (shown in FIG. 4 in phantom lines) as compared to the cutter 40 when mounted by the fastener 42 in the first mounting bore 44 in the top end surface 36. This enables a single body 12 to be used with the same diameter cutter 40 to cut wallpaper 46 of different thickness in a precise manner. As shown in FIG. 3, the excess end portion 48 of the wallpaper 46, which generally overlays the ceiling of a room, can be cut at the juncture of the ceiling and wall without damaging the tape, plaster or seam between the plaster or drywall sheets normally used to cover the wall 50 and ceiling 52. When a different thickness paper is employed, the cutter 40 is adjusted into position by placing the fastener 42 in one of the first or second mounting bores 44 or 45 respectively formed in the top end surface 36 so as to position the cutting edge 41 of the cutter 40 in a precise location to accommodate the different thickness wallpaper 46.

In an alternate aspect of the first implementation, a plurality of mounting bores located in spacial relationship to one another may be employed to increase the adjustability of the depth of cut. In another aspect, an elongated bore may be employed to provide increased adjustment in the depth of cut.

2. An alternate depth of cut adjusting means provides a plurality of independent, interchangeable cutters 40 and 40' (40' shown in FIG. 4 as dashed lines), having varying lengths 43 and 43' from the peripheral cutting edge 41 and 41' to the point of attachment in, for example, first mounting bore 44 and fastener 42 on the top end surface 36 of the body 12. The appropriate cutter 40 or 40' having the desired length 43 or 43' is chosen so as to place the peripheral cutting edge 41 at the desired distance from the body exterior periphery, shown in FIG. 4 as side wall 20, for precise cutting of the excess portion 48 from the wallpaper strip 46 depending on the thickness of the wallpaper 46. It is understood that second mounting bore 45 may compliment this aspect and further increase the amount of adjustability.

Referring to FIG. 3, regardless of which depth of cut adjusting means is employed, when the desired cutter 40 or 40' is mounted on the top end surface 36 by the fastener 42, the body 12 is brought into contact with a vertical wall 50, with the sidewall 20 of the body 12 abutting the vertical wall 50. The body 12 is urged upward along the vertical wall 50 until the top edge 38 of wall 34 contacts the ceiling 52. This places the peripheral cutting edge 41 of the cutter 40 at a position to precisely trim the excess portion 48 from the wallpaper strip 46 at the exact juncture or joint of the wall 50 and ceiling 52. Any imperfections in the desired straight joint between the wall 50 and ceiling 52 are easily accommodated since the engagement of the top edge 38 of the body 12 with the ceiling 52 and the side wall 20 of the body 12 with the vertical wall 50 will maintain the cutting edge 41 in a precise location to cut the wallpaper 46 at the joint between the wall 50 and the ceiling 52 as the body 12 is slid along wall 50.

Upon cutting edge 41 becoming dull or of sufficient bluntness to inefficiently cut wallpaper 46, fastener 42 is removed from the appropriate mounting bore 44 or 45 and the spent cutter is removed and replaced with a new or refurbished cutter 40 of the desired length 43. In a preferred aspect, wallpaper cutter 10 includes end cap 26 wherein alternate and replacement cutters are stored for easy and efficient replacement. In an alternate aspect, the replacement cutters are stored in a cavity in body 12.

It is also contemplated that the cutter 40 may be retractably mounted on the top end surface 36 so as to be removable and lockable in the cutting position shown in FIGS. 1, 3 and 4, as well as a retracted position in which the entire peripheral cutting edge 41 of the cutter 40 is positioned within the periphery of the top edge surface 36 of the body 12 to prevent any accidental contact with the sharp cutting edge of the cutter 40.

The above-described construction and use of the wallpaper cutter 10 to trim excess wallpaper 48 from a hung strip of wallpaper 46 at a wall-to-ceiling joint is also applicable to trimming excess wallpaper 46 at a wall-to-wall joint between two adjacent walls or other joints such as a wall-to-floor or wall-to-trim molding.

What is claimed is:

1. A wallpaper cutter comprising:

an elongate body having an exterior periphery, a top end and a bottom end, said top end having a top end surface and a top edge adjacent to said top end surface, said top end surface having an angled slope from said periphery toward said top edge; and a cutter attached to said top end surface of said body in substantially parallel orientation to said top end surface, said cutter comprising a circular disk having a peripheral cutting edge.

2. A wallpaper cutter comprising:

an elongate body having an exterior periphery, a top end and a bottom end, said top end having a top end surface and a top edge adjacent to said top end surface, said top end surface having an angle slope from said periphery toward said top edge, said bottom end comprising a removable end cap, said end cap having an interior chamber, and a cutter attached to said top end surface of said body in substantially parallel orientation to said top end surface.

3. The wallpaper cutter of claim 1, wherein said body further comprising at least one substantially flat side between said top end and said bottom end.

4. The wallpaper cutter of claim 1, said body further having an interior cavity.

5. A wallpaper cutter comprising:

an elongate body having an exterior periphery, a top end and a bottom end, said top end having a top end surface and a top edge adjacent to said top end surface, said top end surface having an angled slope from said periphery toward said top edge;

a cutter attached to said top end surface of said body in substantially parallel orientation to said top end surface, said cutter including a cutting edge and a length from said cutting edge to a point of attachment of said body; and means for adjusting the depth of cut by said cutter, said means for adjusting the depth of cut including a plurality of said cutters each varying in said length and wherein said cutters are interchangeably attached to said body.

6. A wallpaper cutter comprising:

an elongate body having a top end and a bottom end, said top end having a top end surface and a top edge adjacent to said top end surface, said top end surface having a downwardly angled slope toward said top edge;

means for cutting said wallpaper, said means for cutting having a cutter attached to said top end surface of said body, said cutter having a cutting edge and a length from said cutting edge to a point of attachment of said cutter to said body; and means for adjusting the depth of cut by said cutter, said means for, adjusting the depth of cut having a plurality of cutters each varying in said length and wherein said cutters are interchangeably attached to said body.

7. A wallpaper cutter comprising:

an elongate body having a top end and a bottom end, said top end including a top end surface having at least one bore and a wall having a base and a top edge, said top end surface having a downwardly angled slope toward said base of said wall, said bottom end further including a removable end cap, said end cap having an internal chamber; and a cutter attached to said top end surface of said body, said cutter having a circular shape and a peripheral cutting edge.

8. The wallpaper cutter of claim 7, wherein said body further comprising at least one substantially flat side between said top end and said bottom end.

9. The wallpaper cutter of claim 6, wherein said bottom end further comprises a removable end cap, said end cap having an interior chamber.

10. The wallpaper cutter of claim 1 wherein the cutting edge of said cutter is positioned substantially planer to said top edge.

* * * * *